United States Patent [19]

Geldner et al.

[11] 4,400,289

[45] Aug. 23, 1983

[54] COMPOSITION AND PROCESS FOR PICKLING AND REMOVING RUST FROM METAL

[75] Inventors: Joachim Geldner; Josef Rones; Horst Danzel, all of Frankfurt, Fed. Rep. of Germany

[73] Assignee: Occidental Chemical Corporation, Warren, Mich.

[21] Appl. No.: 346,331

[22] Filed: Feb. 5, 1982

[30] Foreign Application Priority Data

Feb. 14, 1981 [DE] Fed. Rep. of Germany ..... 3105508

[51] Int. Cl.[3] ..... C11D 7/08; C23G 1/08; C23G 1/12; C11D 7/10

[52] U.S. Cl. ..... 252/142; 134/3; 134/41

[58] Field of Search ..... 134/3, 41; 252/142

[56] References Cited

U.S. PATENT DOCUMENTS 2,408,424 10/1946 Healy et al. ..... 252/142
2,631,950 3/1953 Rosenfeld et al. ..... 252/142

FOREIGN PATENT DOCUMENTS 1950560 1/1979 Fed. Rep. of Germany .

*Primary Examiner*—John E. Kittle
*Assistant Examiner*—Robert A. Wax
*Attorney, Agent, or Firm*—Richard P. Mueller

[57] ABSTRACT

A pickling and rust-removing paste composition suitable for cleaning metal surfaces, including surfaces of steel and aluminum. The composition contains fluoride ions and a mixture of calcium compounds and tervalent iron and/or aluminum compounds and has an acidity corresponding to at least 10% by weight of free acid, calculated at 100% HF. The composition also most preferably contains at least one anion selected from nitrate, sulfate, phosphate and chloride and has an acidity corresponding to from about 15 to 30% by weight of free acid, calculated as 100% HF.

The composition is applied to that portion of the metal surface, such as steel or aluminum, to be treated and is retained in contact with the surface for a period of time sufficient to effect the desired pickling and/or removal of rust on the surface.

10 Claims, No Drawings

COMPOSITION AND PROCESS FOR PICKLING AND REMOVING RUST FROM METAL

This invention relates to a composition and process for cleaning metal surfaces and more particularly relates to a composition and process for pickling and removing rust from steel and/or aluminum surfaces.

BACKGROUND OF THE INVENTION

It is known to treat surfaces of steel, aluminum, and/or their alloys, to remove therefrom unsightly and corrosion-promoting oxide layers, such as are formed by contact with the environment and/or in the course of welding or other heat treatments of the metal surfaces. Typically, this is done by treatment with acid solutions, such as those based on hydrochloric acid, sulfuric acid, phosphoric acid, hydrofluoric acid, and the like.

In some cases, particularly with large parts, where there are localized areas of oxide formation, acid-containing paste have been applied only to the places that are to be cleaned. In this manner, part of the oxides and the underlying metal attached to them are dissolved, so that the oxides lose their adhesion to the metal surface. After an appropriate contact time with the paste composition, it can be rinsed off with water or removed by brushing.

Typical of pickling and rust removing paste of this type are those based on phosphoric acid and containing, as a thickener, a saponifiable oil or a fatty acid which can be converted to a soap. Such compositions are described in West German Auslegeschrift No. 1082475.

Another known composition of this type, which is described in West German Auslegeschrift No. 1950560, contains hydrofluoric acid, a magnesium compound, at least one acid selected from nitric acid, phosphoric acid and sulfuric acid, which acids are in the form of free acid or of their salts and further containing a particular sulfonic acid. Although compositions of this type have been found to have advantages over other types of pickling and rust removing pastes, difficulties have sometimes been encountered in achieving the pasty consistency necessary for brush-on applications and also in providing the necessary quantity of pickling acid per unit surface of metal being treated. Attempts to overcome the problems of the consistency by the addition of thickeners has not been successful since such additions result in a further reduction in the content of the pickling acid that is present on the surface.

In the case of types of pickling pastes which contain a filler, such as barium sulfate, there is frequently at least a partial settling out of the filler during prolonged standing of the composition so that the paste has to be intensively stirred and homogenized before each application. Moreover, when such compositions contain volatile acids, such as nitric acid or hydrochloric acid, in addition to hydrofluoric acid, irritating and/or toxic vapors may be released from the liquid phase which forms as settling occurs, thus making handling of the composition, when the containers are opened, not only difficult but potentially dangerous. Finally, difficulties have also been encountered in rinsing such paste from the treated surface since the filler materials frequently collect in the pores of the metal being treated.

It is, therefore, an object of the present invention to provide a pickling and rust remover paste for the cleaning of metal surfaces, such as steel and/or aluminum, which is not subject to the aforementioned disadvantages of the prior art compositions.

A further object of the present invention is to provide an improved pickling and rust-remover paste which attains the desired paste consistency with relatively low additions of fillers; which can be easily removed from the metal surfaces to which it is applied; and which is also economical to produce.

These and other objects will become apparent to those skilled in the art from the description of the invention which follows.

SUMMARY OF THE INVENTION

It has now been found that the problems of the prior art compositions are overcome by using a pickling and rust-removing paste which comprises fluoride ions, a mixture of one or more calcium compounds with one or more tervalent iron and/or aluminum compounds and which has an acidity corresponding to at least 10% by weight of free acid, calculated as 100% HF. This composition is found to have the necessary paste consistency with the addition of relatively low amounts of the mixture of calcium and tervalent iron and/or aluminum compounds, thus further providing the required amount of pickling acid per unit surface of metal being treated. This result is surprising in that it has been found that the compounds of calcium, tervalent iron, or aluminum, when used alone, do not produce these results.

DETAILED DESCRIPTION OF THE INVENTION

More specifically, the pickling and rust removing paste of the present invention contains fluoride ions in an amount of at least about 5% by weight of the total composition, which fluoride ions are typically added as hydrofluoric acid. The upper limit of the concentration of fluoride ions in the composition has not been found to be critical, but, rather, it is dictated by the practical considerations of formulating and handling the composition. Typically, fluoride ion concentrations of 30% by weight of the total composition, or even higher in some instances, may be used. Preferably, the fluoride ion concentration of the composition is within the range of about 10 to 15% by weight of the total composition and is typically added in the form of hydrofluoric acid.

In addition to the fluoride ions, the present pickling and rust removing paste composition contains a mixture of calcium compounds and tervalent iron and/or aluminum compounds in an amount of from about 1 to about 10% by weight of the total composition, which amounts are calculated as the cation. Preferably, the composition will contain from about 2 to about 7% by weight of the mixture of these compounds, calculated as the cation. In formulating the composition, the content of the calcium compounds and the tervalent iron and/or aluminum compound is preferably adjusted so that the mole ratio, calculated as the cation, of the calcium compounds to the tervalent iron and/or aluminum compounds, is from about 3:1 to about 1:3, and is preferably about 1:1.

The calcium compounds and the tervalent iron and/or aluminum compounds are preferably added to the composition in the form of their soluble salts, such as the nitrate and chloride salts. These components may, however, be introduced in the form of other compounds, such as the oxides, hydroxides, sulfates, phosphates, and the like. In many instances, it has been found that a particularly effective pickling and rust removing paste composition is obtained by the inclusion of nitrate, sulfate, phosphate, and/or chloride ions in the composition. The inclusion of nitrate ions has been found to be particularly effective when the composition is to be used for the cleaning of alloy steels, such as chromium steels and/or nickel steels. Where these anions are included in the composition, they are typically present in the final composition in amount such that the mole ratio of fluoride ion in the composition to the sum of the sulfate, phosphate, nitrate and/or chloride ions is from about 3:1 to about 1:6 and is preferably from about 1:1 to about 1:4.

The incorporation of the aforementioned additional anions in the composition can be effective in the form of the acids or salts, typically, the calcium and tervalent iron or aluminum salts. Other salts, such as the alkaline metal salts, may also be used. The only criteria for the selection of the form of the compounds which are to be added is that at least a portion of one of the components is added as the free acid so that the minimum acidity of at least 10% by weight of free acid, calculated as 100% HF, is obtained. There is no criticality as to the maximum amount of free acid in the composition, this amount again being governed by the practical considerations of the formulation in handling of the composition. In general, the rate at which the composition effects cleaning of the metal surface to which it is applied will increase as the free acid content of the composition is increased. Particularly fast acting pickling and rust-removing compositions are obtained when the acidity corresponds to from about 15 to about 30% by weight of free acid, calculated as 100% HF.

In formulating the pickling and rust-removing paste composition of the present invention, the calcium compounds and the tervalent iron and/or aluminum compounds can be separately premixed in the same or different acid components of the composition and the resulting individual mixtures combined. Alternatively, the calcium compounds and tervalent iron and/or aluminum compounds can be added to the acid components of the composition. Once the mixture of all of the components of the composition has been obtained, the mixture may be stirred until the desired thickening of the composition has taken place. Alternatively, however, the mixture, while still fluid, may be put into suitable containers and, in this instance, the desired thickening of the composition will take place, without further mixing, during storage of the containers.

The pickling and rust removing paste compositions of the present invention may be used in this thickened form as produced. In this instance, application of the composition by brush coating is the typical application technique used. If desired, however, the paste composition may be thinned with water or acids and then applied to the metal surface to be cleaned by spray coating techniques. Regardless of the technique used, the composition is applied to the metal surface to be treated and is retained in contact with the surface for a period sufficient to effect the desired pickling and/or cleaning of the surface. Thereafter, the composition is removed from the surface by brushing, water rinsing, or the like. The composition of the present invention are found to produce excellent pickling and rust removing results. Additionally, even after prolonged periods of storage, the compositions are found to retain their desired consistency with no separation of the solid components of the composition nor any formation of noxious and/or toxic fumes in the storage container.

SPECIFIC EXAMPLES

In order that those skilled in the art may better understand the present invention and the manner in which it may be practiced, the following specific examples are given.

EXAMPLE 1

A pickling and rust removing composition was formed by mixing the following components in the amount indicated:

| | |
|---|---|
| Nitric Acid (50% concentration) | 35% by weight |
| Hydrofluoric Acid (40% concentration) | 35% by weight |
| Aluminum Nitrate.$9H_2O$ | 15% by weight |
| Calcium Nitrate.$4H_2O$ | 15% by weight |

After mixing these components, a paste composition was formed which was translucent in appearance and had a density of about 1.25 g/cm$^3$. After storage of this composition in a container for several weeks no separation of the solid components had occurred nor was there any formation of red nitrous oxide vapors in the container. The composition was applied to a welding seam on a chrome alloy steel pipe. About 1 kg of the composition, applied in a strip 5 cm wide, was sufficient to treat a welding seam that was 120 m in length. Upon removing the composition from the metal surface, it was found that excellent pickling and rust-removing of the surface treated had been obtained.

EXAMPLE 2

A pickling and rust-removing composition for cleaning aluminum surfaces was prepared by mixing the following components in the amounts indicated:

| | |
|---|---|
| Hydrofluoric acid (40% concentration) | 28% by weight |
| Phosphoric Acid (75% concentration) | 31% by weight |
| Water | 16% by weight |
| Di-hydrogen aluminum phosphate | 20% by weight |
| Calcium Oxide | 5% by weight |

The resulting composition, which was in fluid form was placed in a container and stored for several weeks. Upon opening the container, it was found that the composition had a consistency similar to that of the composition of Example 1 and that there had been no separation of the components or formation of noxious or toxic fumes in the container. 10 m$^2$ of aluminum surface were treated with 1 kg of this composition and excellent cleaning of the surface was obtained.

EXAMPLE 3

The procedure of Example 1 was repeated with the exception that, in one instance, the composition contained:

| | |
|---|---|
| Fe $(NO_3)_3.9H_2O$ | 15% by weight |
| Ca $(NO_3)_2.4H_2O$ | 18% by weight |
| HF (40% by weight) | 37% by weight |
| $HNO_3$ (65% by weight) | 30% by weight |

and in the second instance, the composition contained:

| | |
|---|---|
| Fe $(NO_3)_3.9H_2O$ | 7% by weight |
| Al $(NO_3)_3.9H_2O$ | 8% by weight |

-continued

| | |
|---|---|
| $Ca(NO_3)_2.4H_2O$ | 18% by weight |
| HF (40% by weight) | 37% by weight |
| $HNO_3$ (65% by weight) | 30% by weight |

In each instance, similar results were obtained.

EXAMPLE 4

By way of comparison, a prior art pickling and rust-removing paste composition suitable for cleaning welding seams on chrome alloy steel, was formed by mixing the following components in the amounts indicated:

| | |
|---|---|
| Nitric Acid (50% concentration) | 25% by weight |
| Hydrofluoric Acid (40% concentration) | 25% by weight |
| Barium Sulfate | 50% by weight |

The resulting paste composition had a density of about 2 g/cm$^3$. After storage in a container for several days, the container was opened and it was found that the filler component of the composition had settled out, forming two phases, and that nitrous oxide vapors had formed in the air space of the container.

What is claimed is:

1. A pickling and rust removing composition for cleaning metal surfaces which comprises fluoride ions, a mixture of calcium compounds and tervalent iron and/or aluminum compounds and which has an acidity corresponding to at least 10% by weight of free acid, calculated as 100% HF.

2. The composition as claimed in claim 1 in which the fluoride ions are present in an amount of at least about 5% by weight of the composition and the mixture of calcium compounds and tervalent iron and/or aluminum compounds is present in an amount from about 1 to 10% by weight of the composition, calculated as the cation.

3. The composition as claimed in claim 2 wherein the fluoride ions are present in an amount of from about 10 to 15% by weight of the composition and the mixture is present in an amount of from about 1 to 7% by weight of the composition.

4. The composition as claimed in claim 2 wherein the mole ratio of calcium to tervalent iron and/or aluminum in the composition is from about 3:1 to about 1:3.

5. The composition as claimed in claim 4 wherein the mole ratio of calcium to tervalent iron and/or aluminum is about 1:1.

6. The composition as claimed in claim 1 wherein there is present at least one anion selected from nitrate, sulfate, phosphate and chloride.

7. The composition as claimed in claim 6 wherein the mole ratio of fluoride ions to the total nitrate, sulfate, phosphate and chloride ions is within the range from about 3:1 to about 1:6.

8. The composition as claimed in claim 7 wherein the mole ratio of fluoride ions to the total of nitrate, sulfate, phosphate and chloride ions is from about 1:1 to about 1:4.

9. The composition as claimed in claim 6 wherein the acidity corresponds to from about 15 to about 30% by weight of free acid, calculated as 100% HF.

10. A process for pickling and/or cleaning metal surfaces which comprises applying to that portion of the surface that is to be cleaned a composition as claimed in claim 1, 2, 3, 4, 5, 6, 7, 8, or 9 and retaining the composition in contact with the metal surface for a period of time sufficient to effect the desired cleaning.

* * * * *